United States Patent [19]

Simkin

[11] Patent Number: 4,603,840

[45] Date of Patent: Aug. 5, 1986

[54] FENCE SUPPORT MEMBER

[76] Inventor: Frank Simkin, 2 Candlemaker Ct., Baltimore, Md. 21208

[21] Appl. No.: 690,590

[22] Filed: Jan. 9, 1985

[51] Int. Cl.[4] ..... E04H 17/00

[52] U.S. Cl. ..... 256/11; 403/4

[58] Field of Search ..... 256/11, 12; 403/4

[56] References Cited

U.S. PATENT DOCUMENTS

| | | | |
|---|---|---|---|
| D. 215,726 | 10/1969 | Skibowski . | |
| 1,401,509 | 12/1921 | Bailey . | |
| 1,489,068 | 4/1924 | Drake . | |
| 1,546,094 | 7/1925 | Marbaugh | 256/11 |
| 1,664,603 | 4/1928 | Farrington . | |
| 1,703,189 | 2/1929 | Getz . | |
| 1,773,519 | 8/1930 | Cox . | |
| 1,798,754 | 3/1931 | Paque . | |
| 1,839,898 | 1/1932 | Skinner . | |
| 1,959,767 | 5/1934 | Sendrowitz | 403/4 X |
| 2,088,890 | 8/1937 | Winby et al. . | |
| 2,351,261 | 6/1944 | Hall . | |
| 2,954,212 | 9/1960 | Cox . | |
| 2,970,799 | 2/1961 | Pinson . | |
| 3,028,147 | 4/1962 | Crumbo . | |
| 3,295,873 | 1/1967 | Attwood . | |
| 3,342,446 | 9/1967 | Curlett et al. . | |
| 3,346,280 | 10/1967 | Pfaff et al. . | |
| 3,524,627 | 8/1970 | Boyanton et al. . | |
| 3,591,211 | 7/1971 | Richey . | |
| 3,698,691 | 10/1972 | Brown . | |
| 4,065,103 | 12/1977 | Sweezey . | |
| 4,079,481 | 3/1978 | Cacicedo . | |
| 4,408,748 | 10/1983 | Lewis . | |

FOREIGN PATENT DOCUMENTS

| | | | |
|---|---|---|---|
| 1129766 | 9/1956 | France | 403/4 |

OTHER PUBLICATIONS

Merchants Metals, Inc. publication, pp. 17 and 18.

*Primary Examiner*—Andrew V. Kundrat

*Attorney, Agent, or Firm*—Roylance, Abrams, Berdo & Goodman

[57] ABSTRACT

A fence support member to attach to an existing fence post or wall, the support member including an elongated support arm and a fastening assembly to fasten the support arm to the fence post or wall. The support arm has spaced slots or holes therein to receive and retain strands of wire or fencing. The support arm has a first end which is designed to abut the existing fence post or wall. The first end includes first and second abutment surfaces which are located on the edge of the first end of the support arm. The abutment surfaces are at an acute angle with each other. The fastening assembly includes a pair of L-shaped brackets, one positioned on each side of the support arm and a U-bolt which is employed to attach the brackets to a fence post. The support arm can be attached to a fence post or wall such that the support arm extends parallel or at an acute angle to the fence post or wall, depending on which abutment surface is in contact with the fence post or wall.

20 Claims, 11 Drawing Figures

FIG.7
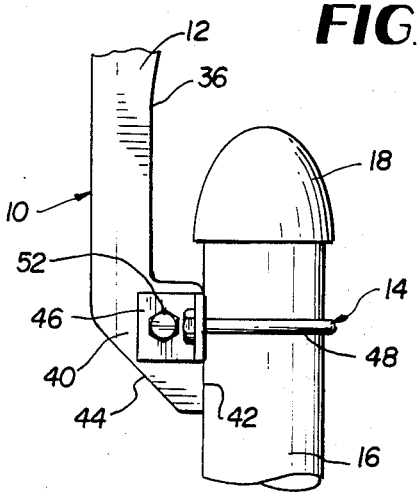
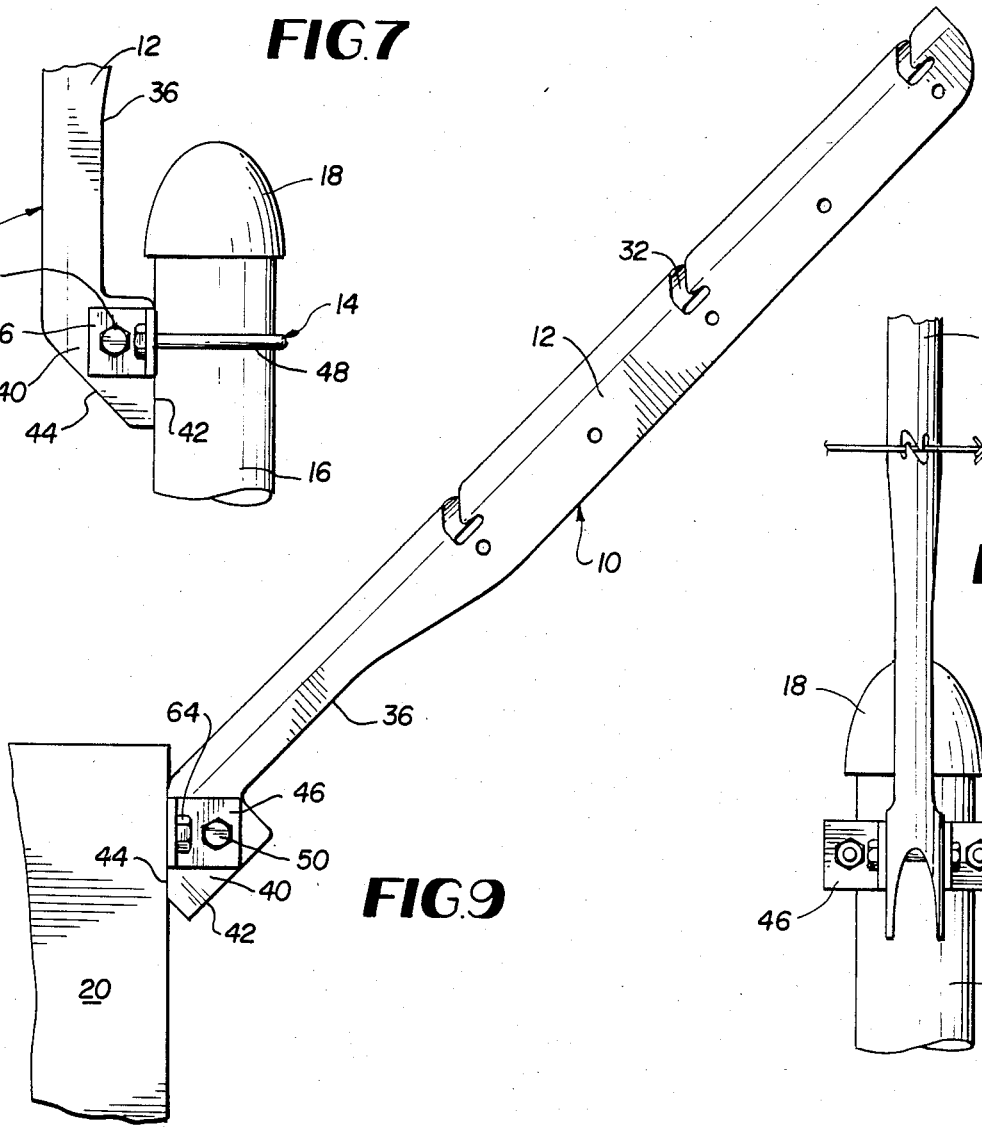
FIG.9
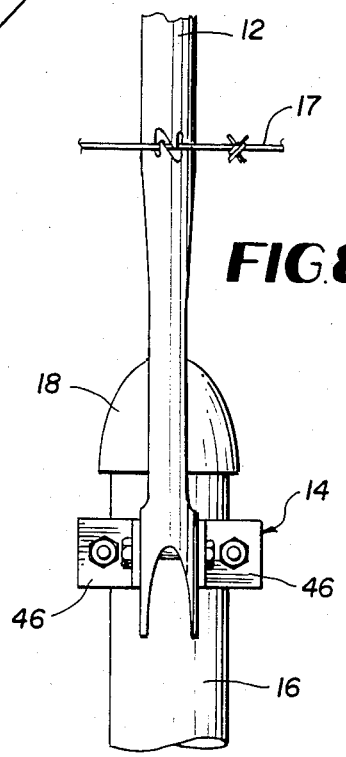
FIG.8
FIG.10
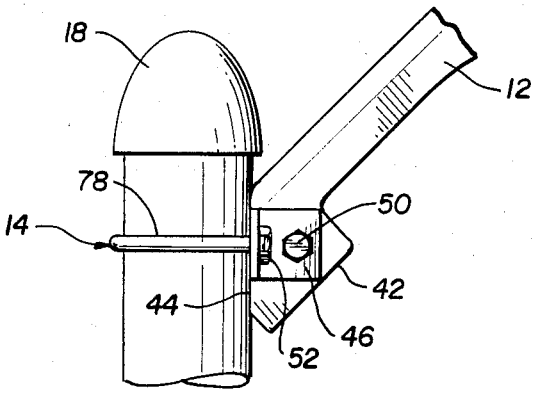
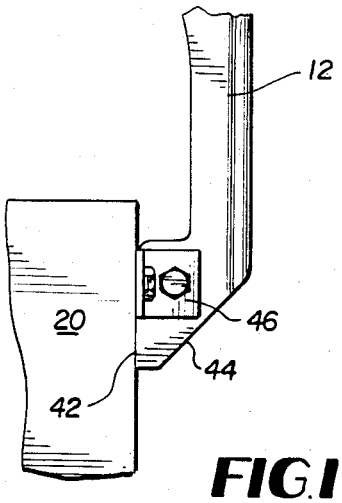
FIG.11

FENCE SUPPORT MEMBER

BACKGROUND OF THE INVENTION

This invention relates to support members for wire fences. More particularly, this invention relates to fence support members which may be attached to and extend above another structure and to which wire strands or fencing may be attached.

FIELD OF THE INVENTION

It is often desired to extend an existing fence, such as a chain link fence, to a height taller than its original height, to add strands of barbed wire or other protective fencing to the top of a chain link or similar fencing or to add fencing or wire strands to the top or side of a wall comprised of brick, concrete, concrete block, etc. It may be desired to add these additional wires or fencing for protective reasons, either to keep animals or children within a fenced or walled area or to keep uninvited persons or stray animals out of a fenced or walled area.

Regardless of the purpose, the addition of these height increasing wires or fencing is usually accomplished by attaching an elongated fence support arm to an existing structure, whether that structure be a fence post, an existing fence or a wall comprised of concrete, brick or other material. The elongated support arm is either attached to extend vertically in line with the fence post or wall, or such that the support arm extends at an angle to the fence post or wall.

These support arms typically have spaced slots, holes or fingers which engage and retain the strands of wire or additional fencing. These prior support arms also include a fastening assembly which is employed to attach the elongated member to an existing fence post or wall. These prior fastening assemblies employed with fence posts have been designed to attach either to the fence post itself, or to the top cap on the fence post. With respect to the support arms which are attached to walls, the fastening members are designed to be attached to either the top or side surface of the walls.

Prior fence support members which are designed to be attached to a fence post or wall can either be employed with a fence post or a wall, but cannot be employed in both environments without altering the support members. Stated differently, none of the prior fence support members designed to be attached to another structure can be universally employed on fence posts and brick or concrete walls. To cover all environments in which the fence support members may be employed, one would have to have at least two different types of the existing fence support members at one's disposal.

Another problem with the existing fence support arms which may be attached to another structure is that often times the fence post or wall to which the support is to be attached has a cap on the post or a ridge or a ledge on or near the top of the wall, for esthetic reasons. The existing fence support members which may be attached to another structure may be incompatible with certain ornamental fence post caps or wall ridges or ledges.

Moreover, some of the existing fence support members which may be attached to other structures are relatively difficult to attach to the existing structure and even when so attached, may be relatively unstable.

Therefore, it is apparent that there exists a need in the art for a fence support member which may be attached to another structure so that wires or fencing may be constructed above the other structure, wherein the support member may be universally employed in conjunction with fence posts and walls, is easy to install and provides clearance for ornamental fence caps or wall ridges and ledges. This invention fulfills this need in the art, along with other needs which become apparent to those skilled in the art once given this disclosure.

SUMMARY OF THE INVENTION

Generally speaking, this invention provides a fence support member to attach to a structural member having a flat side surface comprising; an elongated support arm having means for receiving and engaging wire strands; and, fastening means for fastening said support arm to the structural member; said fastening means being received by the support arm; said support arm having a first end which is designed to abut the straight side surface of said support member; said first end having first and second abutment surfaces, said abutment surfaces being located on the edge of the first end of said support arm; said first and second abutment surfaces being at an acute angle with each other and being designed to selectively abut the flat side surface of the structural member; said first and second abutment surfaces being designed and arranged such that when said first abutment surface is in abutment with the flat side surface, the support arm forms a first angle with the structural member, and when the second abutment surface is in abutment with the structural member, the support arm forms a second angle with the structural member.

In some embodiments of this invention, the support arm may have a U-shaped cross section with a bottom portion and two side portions. The receiving and engaging means may be slots which are spaced along the bottom portion of the support arm. These slots may be S-shaped to provide a secure connection of the additional wire strands or fencing to the support member.

In further embodiments of this invention, the fastening means may include a pair of brackets, one of the brackets being positioned on each side of the support arm. The brackets may be L-shaped with a first flange which is designed to abut the support member and a second flange which is designed to face the existing structural member. The fastening means may further include a U-bolt which is designed to surround and engage a fence post and be connected on its ends to the two brackets.

In yet other embodiments of this invention, the brackets and support arm are connected by a bolt which extends through the brackets and the support arm.

In further embodiments of this invention, the support arm may have a recessed portion which extends downward from the top edge of the side portions of the support arm. The recessed portion is located adjacent the first end of the support arm so that any ornamental design on top of a fence post or ornamental ledge on a wall can be received within the recessed portion.

The fence support members according to this invention have many advantages over the previously known fence support members, including the advantage that these support members can be attached to a fence post or a wall, either vertically relative thereto or at an angle therewith, without modifying the member. This fact that the fence support members according to this invention can be universally employed enables a wholesaler, distributer or contractor to reduce its inventory of such fence support members and parts since a single line of support members according to this invention can be employed in all environments.

A further advantage of fence support members according to this invention is that the members may be attached to a fence post which has an ornamental cap or a wall which has an ornamental ridge. The recessed portions of the support members receive the ornamental caps or ledges therein without having to adjust the support members or remove the ornamental caps or ledges.

Yet another advantage of fence support members according to this invention is that these members can be quickly and easily attached to existing fence posts and walls. This reduces the time and level of labor skill necessary to install strands of wire or fencing to the top of an existing fence or wall. Also, it is an advantage of fence support members according to this invention that the fastening member firmly engages the existing structural member so that the support members can support normal loading.

Certain embodiments of this invention will now be described with reference to the drawings, wherein:

BRIEF DESCRIPTION OF THE DRAWING

FIG. 7 is a side view of an embodiment of this invention attached to a fence post.

FIG. 8 is a rear view of the embodiment of this invention and fence post as illustrated in FIG. 7.

FIG. 9 is a side view of the embodiment of this invention illustrated in FIG. 8 attached to the side of a wall.

FIG. 10 is a partial side view illustrating the embodiment of this invention illustrated in FIGS. 8 and 9 attached at an angle to a fence post.

FIG. 11 is a partial side view of the embodiment of this invention illustrated in FIGS. 8–10 attached vertically to a wall.

DETAILED DESCRIPTIONS OF THE DRAWINGS

Figure 1:
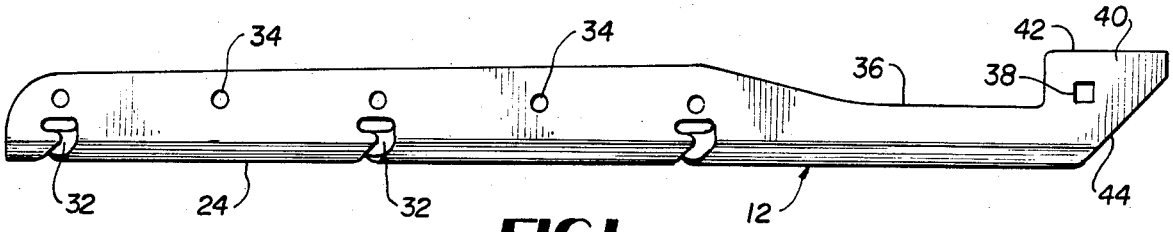
FIG. 1 is a side view of the support arm of one embodiment of this invention.
Figure 2:
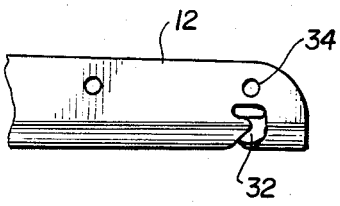
FIG. 2 is a partial side view of the support arm illustrated in FIG. 1, illustrating the side of the support arm opposite of the side viewed in FIG. 1.

Referring to the Figures, fence support member 10 is illustrated including support arm 12 and fastening assembly 14. Fence support member 10 may be attached either to an existing fence post, such as fence post 16 (see FIGS. 7, 8 and 10) or to a wall, such as wall 20 (see FIG. 9).

Figure 4:
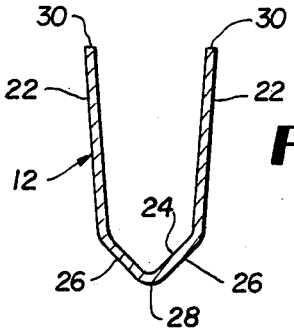
FIG. 4 is a cross section view, taken along reference line 4—4 of FIG. 3, of the support arm illustrated in FIGS. 1–3.
Figure 5:
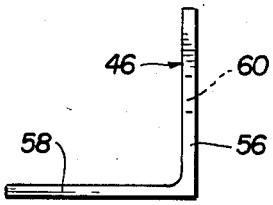
FIG. 5 is a side view of a bracket which may be employed in certain embodiments of this invention.
Figure 6:
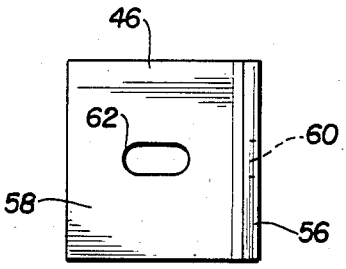
FIG. 6 is a top view of the bracket illustrated in FIG. 5.

Support arm 12 has a U-shaped cross section as illustrated in FIG. 4. Support arm 12 includes two side portions 22 and a bottom portion 24. In turn, bottom portion 24 is formed by two sloped portions 26 joined by a bottom curved portion 28. Side portions 22 have upper edges 30 as shown in FIG. 4.

In this embodiment of the invention, support arm 12 includes three spaced slots 32 and five spaced apertures 34 which are designed to receive strands of wire or fencing and retain the same therein. Any number of slots 32 and apertures 34 can be provided as desired, depending on the length of support arm 12 and the desired spacing of the wire strands. In the embodiment illustrated in the Figures, slots 32 are S-shaped.

Figure 3:
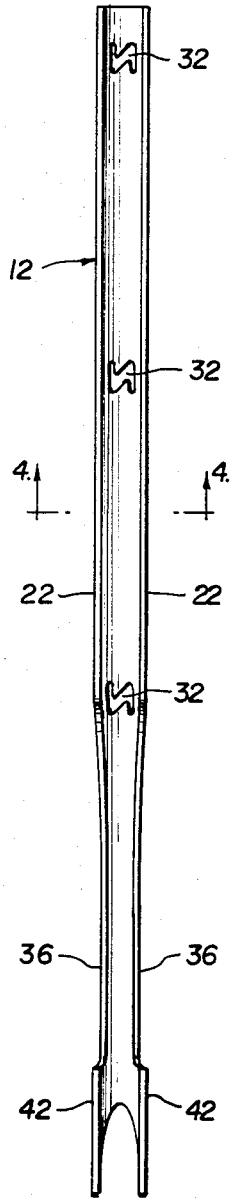
FIG. 3 is a bottom view of the support arm illustrated in FIGS. 1 and 2.

Support arm 12 also includes recessed portions 36, apertures 38 and first end 40. Recessed portions 36 are in side portions 22 of support arm 12 and extend from the upper edges 30 of side portions 22 downward. Recessed portions 36 extend lingitudinally from adjacent first end 40 to adjacent the first slot 32 (see FIGS. 1 and 3). Apertures 38 can be circular or square, depending if it is desired to use a carrier bolt.

First end 40 includes first abutment surfaces 42 and second abutment surfaces 44. Surfaces 42 and 44 are located along the edge of first end 40 and form an acute angle with each other. In the embodiment illustrated in the Figures, this acute angle is a 45° angle.

Fastening assembly 14 includes two L-shaped brackets 46, U-bolt 48, bolt assembly 50 and nuts 52.

Brackets 46 have legs 56 and 58. Legs 56 are designed to abut against the side portions 22 of support arm 12 and legs 58 are designed to face and/or abut the fence post or wall to which support member 10 is being attached. Legs 56 have apertures 60 therein which receives the bolt of bolt assembly 50. This bolt extends through both legs 56 and apertures 38 in support arm 12 to attach brackets 46 to support arm 12. Legs 58 have slots 52 therein which are designed to receive the free ends of U-bolt 48. Slots 62 are in the shape of slots so that different size U-bolts can be employed to interface with different diameter fence posts.

Nuts 52 are attached to the ends of U-bolt 48 to retain U-bolt 48 in place around fence post 16.

The embodiment of this invention illustrated in the Figures is designed to be attached to a fence post or wall as follows:

Brackets 46 are attached to support arm 12 by bolt assembly 50, one bracket 46 being on each side of support arm 12. The bolt is passed through apertures 60 in legs 56 and apertures 38 in side portions 22 and a nut is attached. When so attached, legs 56 of brackets 46 are abutting side portions 22 of support arm 12. If the fence support member 10 is to be attached to a wall, such as wall 20 in FIG. 9, at an angle to the wall, second abutment surfaces 44 are brought into contact with wall 12 and brackets 48 are positioned such that legs 58 abut wall 20. Bolts 64 are then driven through slots 62 in legs 58 to retain support arm 12 in place. Fastening means other than bolts 64 can be employed to attach brackets 46 to wall 20 as desired. When support arm 12 is attached to wall 20 in this manner, support 12 forms a 45° angle with wall 20.

Support arm 12 can also be attached to wall 20 as shown in FIG. 11. In this Figure, first abutment surfaces 42 are brought into contact with wall 20. Brackets 46 are again positioned such that legs 58 are in contact with wall 20. Bolts or other fastening means can then be employed to attach legs 58 to wall 20. When support arm 12 is attached to wall 20 in this manner, support arm 12 extends upward parallel to wall 20.

As discussed above, support arm 12 can also be attached to a fence post, such as fence post 16. As with wall 20, support arm 12 can be attached to fence post 16 such that it extends at a 45° angle to fence post 16 (see FIG. 10) or extends vertically parallel to fence post 16 (see FIGS. 7 and 8).

To position support arm 12 such that it extends vertically parallel to fence post 16, first abutment surfaces 42 are brought into contact with fence post 10 and brackets 46 are positioned such that legs 58 extend parallel of fence post 16. U-bolt 48 is then placed around fence post 16 in contact with fence post 16 and the ends of U-bolt 48 are inserted through slots 62 in legs 58. Nuts 52 are then threaded on the ends of U-bolt 48 to retain it in place. When support arm 12 is so positioned, ornamental cap 18 on the top of fence post 16 is received within recessed portions 46 (See FIG. 7).

Support arm 12 is attached at a 45° angle to fence post 16 by bringing second abutment surfaces 44 into contact with fence post 16. Brackets 46 and U-bolt 48 are then positioned and connected as discussed above.

After the support arm 12 has been positioned in any of the four possible environments discussed above, wire strands 17 can then be threaded through slots 32 and/or apertures 34 as desired. This will form a fence extension on top of an existing fence or wall for additional security.

Once given the above disclosure, many other improvements, modifications and embodiments will become apparent to those skilled in the art. Such other improvements, modifications and embodiments are considered to be within the scope of this invention as defined by the following claims:

I claim:

1. A fence support member to attach to a structural member having a straight side surface comprising:

an elongated support arm having means for receiving and engaging wire strands, and, fastening means for fastening said support arm to the structural member, said fastening means being received by the support arm, said support arm having a first end which is designed to abut the straight side surface of said support member, said first end having first and second abutment surfaces, said abutment surfaces being located on the edge of the first end of said support arm, said first and second abutment surfaces being at an acute angle with each other and being designed to selectively abut the straight side surface of the structural member, said first and second abutment surfaces being designed and arranged such that when said first abutment surface is in abutment with the straight side surface, the support arm forms a first angle with the structural member, and when the second abutment surface is in abutment with the straight side surface, the support arm forms a second angle with the structural member, said fastening means including a pair of brackets, one bracket positioned on each side of the support arm.

2. A fence support member according to claim 1 wherein said elongated support arm has a U-shaped cross section having a bottom portion and two side portions.

3. A fence support member according to claim 2 wherein said receiving and engaging means are slots spaced along the bottom portion of the support arm.

4. A fence support member according to claim 3 wherein the slots are S-shaped.

5. A fence support member according to claim 1 wherein the brackets are L-shaped.

6. A fence support member according to claim 5 wherein the fastening means further includes a U-bolt connected to the brackets.

7. A fence support member according to claim 1 wherein the brackets and support arm are connected by a bolt.

8. A fence support member according to claim 2 wherein the side portions of the support arm have identical recessed portions extending downwardly from the top of the side portions, said recessed portion being adjacent the first end.

9. A fence support member according to claim 1, wherein the engaging and receiving means further comprises spaced holes.

10. A fence support member according to claim 1, wherein said first angle is substantially 180° and said second angle is an acute angle.

11. A fence support member according to claim 10, wherein said acute angle is approximately 45°.

12. A fence support member to attach to a structural member comprising:

an elongated support arm having means for receiving and engaging wire strands, and, fastening means, said fastening means being adapted to fasten said support arm to the structural member, said fastening means being received by the support member, said elongated support arm having a first end designed to abut said structural member, said support arm having a U-shaped cross section with two side portions and a bottom portion, said receiving and engaging means being spaced slots in the bottom portion of the support arm, said side portions having identical recessed portions extending downwardly from the top thereof, said recessed portions being adjacent the first end, wherein the fastening means includes a pair of brackets, one bracket positioned on each side of the support arm, said brackets and support arm being connected by a bolt, said fastening means also including a U-bolt, said U-bolt being connected on its ends to the brackets.

13. A fence support member according to claim 12 wherein the first end includes first and second abutment surfaces, said first and second abutment surfaces forming an acute angle with each other.

14. A fence support member according to claim 12 wherein the structural member is a chain link fence including fence posts with ornamental fence posts caps, said caps extending into the recessed portions when the support member is attached to the chain link fence.

15. A fence support member to attach to a structural member comprising:

an elongated support arm having means for receiving and engaging wire strands, and, fastening means for fastening said support arm to the structural member, said fastening means being received by said support arm, said support arm having a U-shaped cross section and a first end designed to abut said structural member, said first end having first and second abutment surfaces for abutting the structural member, said abutment surfaces forming an acute angle with each other, said fastening means including a pair of brackets, one of said brackets being on each side of the support arm and a U-bolt which extends between the brackets.

16. A fence support member according to claim 15 wherein the structural member is a fence post and wherein the fastening member further comprises a U-bolt for surrounding and engaging the fence post.

17. A fence support member according to claim 16 wherein the brackets are L-shaped having a first leg abutting the support leg and a second arm having a hole to receive the U-bolt.

18. A fence support member comprising:

an elongated support arm having means for receiving and engaging wire strands, and, a fastening assembly, said fastening assembly being received by the support arm, said support arm having a lower end, said lower end having first and second abutment surfaces, said abutment surfaces being located on the edge of the first end of said support arm, said first and second abutment surfaces being at an acute angle with each other and being designed to selectively partially support the support member, said first and second abutment surfaces being designed and arranged such that when said first abutment surface is partially supporting the support member, the support arm is in a first position, and when the second abutment surface is partially supporting the support member, the support arm is in a second position, said fastening assembly including a pair of brackets, one bracket positioned on each side of the support arm.

19. A fence support member according to claim 18, wherein said fastening assembly further comprises a U-bolt, said U-bolt being connected on its ends to the brackets.

20. A fence support member according to claim 19 wherein said fastening assembly further comprises a bolt assembly, said bolt assembly connecting said brackets with said support arm.

* * * * *